US011839992B2

(12) United States Patent
White et al.

(10) Patent No.: US 11,839,992 B2
(45) Date of Patent: Dec. 12, 2023

(54) PRINTER WASTE DIVERTERS

(71) Applicant: Kodak Alaris Inc., Rochester, NY (US)

(72) Inventors: Trevor White, Rochester, NY (US); Richard S. Paoletti, Rochester, NY (US); Joseph Repass, Rochester, NY (US)

(73) Assignee: KODAK ALARIS INC., Rochester, NY (US)

( * ) Notice: Subject to any disclaimer, the term of this patent is extended or adjusted under 35 U.S.C. 154(b) by 23 days.

(21) Appl. No.: 17/494,439

(22) Filed: Oct. 5, 2021

(65) Prior Publication Data

US 2022/0105654 A1 Apr. 7, 2022

Related U.S. Application Data

(60) Provisional application No. 63/087,587, filed on Oct. 5, 2020.

(51) Int. Cl.

| | |
|---|---|
| ***B26D 5/08*** | (2006.01) |
| ***B41J 11/68*** | (2006.01) |
| ***B41J 11/70*** | (2006.01) |
| ***B26D 7/18*** | (2006.01) |
| ***B26D 7/00*** | (2006.01) |
| ***B41J 11/66*** | (2006.01) |

(Continued)

(52) U.S. Cl.

CPC ..... *B26D 7/18* (2013.01); *B26D 5/08* (2013.01); *B26D 7/0006* (2013.01);

(Continued)

(58) Field of Classification Search

CPC .. B26D 7/18; B26D 7/0006; B26D 2007/005; B26D 5/08; B26D 9/00;

(Continued)

(56) References Cited

U.S. PATENT DOCUMENTS 5,139,205 A * 8/1992 Gallagher ..... B02C 18/0007 241/101.2
6,408,750 B1 * 6/2002 Goto ..... B26D 7/22 400/621

(Continued)

FOREIGN PATENT DOCUMENTS

JP H0564771 A * 3/1993 ..... B07B 4/02
JP H0565901 U * 8/1993 ..... B65F 1/00
JP 2006088453 A * 4/2006 ..... B41J 11/70

OTHER PUBLICATIONS

International Search Report and Written Opinion dated Jan. 17, 2022 in International Application No. PCT/US2021/053625.

(Continued)

*Primary Examiner* — Yaovi M Ameh
(74) *Attorney, Agent, or Firm* — HOGAN LOVELLS US LLP

(57) ABSTRACT

A mechanism is described herein to drive slitter and cutter waste in a direction that allows for a more advantageous use of the waste collection bin's volume. The waste drive mechanism allows for at least one armature that drives the waste in a desired direction. The armature is made from a material that is flexible, with a curved shape to allow a pre-loaded force against a contact surface of the waste collection bin. The pre-loaded flexible armature against a contact surface of the collection bin provides sufficient force to drive the waste it in a desired direction, allowing for a more consistent use of the waste collection bin spatial volume.

6 Claims, 18 Drawing Sheets

(51) Int. Cl.
*B26D 9/00* (2006.01)
*B41J 2/325* (2006.01)

(52) U.S. Cl.
CPC ..... *B41J 11/663* (2013.01); *B41J 11/68* (2013.01); *B41J 11/70* (2013.01); *B26D 9/00* (2013.01); *B26D 2007/005* (2013.01); *B26D 2007/0018* (2013.01); *B26D 2007/189* (2013.01); *B41J 2/325* (2013.01)

(58) Field of Classification Search
CPC ..... B26D 2007/0018; B26D 2007/189; B41J 11/70; B41J 2/325; B41J 11/68; B41J 11/663
See application file for complete search history.

(56) References Cited

U.S. PATENT DOCUMENTS

| | | | |
|---|---|---|---|
| 6,408,751 | B1 | 6/2002 | Walczak |
| 7,163,287 | B2 | 1/2007 | Silverbrook et al. |
| 3,312,798 | A1 | 11/2012 | Kwarta et al. |
| 8,312,798 | B2 | 11/2012 | Kwarta et al. |
| 2005/0262986 | A1 | 12/2005 | Connor |

OTHER PUBLICATIONS

International Preliminary Report on Patentability and Written Opinion mailed in PCT/US2021/053625 dated Mar. 28, 2023.

* cited by examiner

PRINTER WASTE DIVERTERS

CROSS-REFERENCE TO RELATED APPLICATIONS

This application is a non-provisional of and claims priority to U.S. provisional application No. 63/087,587, filed on Oct. 5, 2020. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

BACKGROUND OF THE INVENTION

While a white margin surrounding printed material is desirable in certain applications, other applications such as photographs are expected to have an image that extends to the edges of the material. To attain this goal, printers such as thermal printers can utilize slitter and cutter mechanisms to remove excess print medium. Slitters cut the print medium in the direction that is perpendicular to the print head, and cutters cut the print medium in the direction that is parallel to the print head. This provides users a wider range of print sizes without requiring numerous pre-cut sizes of print media. Slitters, cutters, and related components are generally known in the prior art, such as those described in U.S. Pat. Nos. 8,312,798 and 7,163,287, which are incorporated by reference.

The waste from slitters and cutters is generally deposited into a waste collection bin to prevent the waste from being ejected with the print medium. The depositing of waste is primarily accomplished by gravity. Slitter waste varies widely depending on the desired print size. For example, 6-inch wide print media (e.g., thermal paper) can be cut using slitters to 4-inch or 1-inch wide depending on the user's preferences. And while cutter waste is generally determined by the printer logic and remains constant regardless of the print size, cutter waste can also vary in certain applications. As such, numerous sizes of waste can be created. Relying on gravity to deposit waste into a waste collection bin often results in inconsistent and inefficient results, especially when the size of waste varies. This can result in problems and inconveniences for the user, such as paper jam conditions or the need to empty waste collection bins more often.

SUMMARY OF THE INVENTION

The inventions described herein solve the problems described above and provide apparatuses and methods to efficiently deposit waste in one or more printer waste collection bins. Specifically, waste diverter mechanisms are described to direct waste into an efficient configuration in one or more waste collection bins. This allows for a more advantageous use of waste collection bin volume and prevents issues such as paper jams.

The waste diverter mechanisms can be made from any flexible material such as plastic. The waste diverter mechanisms can be made with a curved shape to allow a pre-loaded force against a contact surface of the collection bin that has a pre-determined volume, such that the pre-loaded flexible armature can provide a sufficient force to drive waste in a desired direction.

In at least one embodiment, one or more waste diverter mechanisms can be used to drive the slitter waste in a direction that is parallel to the print head.

In at least one embodiment, the slitter waste and cutter waste can be deposited into the same separate collection bin with a pre-determined volume.

In at least one embodiment, the slitter waste and cutter waste can be deposited into separate collection bins with pre-determined volumes.

In at least one embodiment, a threshold can be set to alert the user that one or more waste collection bins are full or at a specified capacity. This threshold can be detected using at least one or more predictive, mechanical, electrical, optical, or other means.

In at least one embodiment, one or more waste collection bins can be connected to a mechanism to shred, compact, or otherwise decrease the volume or dispose of the waste. For example, a vacuum or chute can be employed to dispose of the waste. Shredding mechanisms known in the prior art can also be used, such as those described in U.S. Pat. App. No. 2011/0293351, which is incorporated by reference.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Systems and methods in accordance with various embodiments of the present disclosure may overcome one or more of the aforementioned and other deficiencies experienced in conventional approaches to collecting waste from a printer.

Various other functions and advantages are described and suggested below as may be provided in accordance with the various embodiments.

Figure 1A:
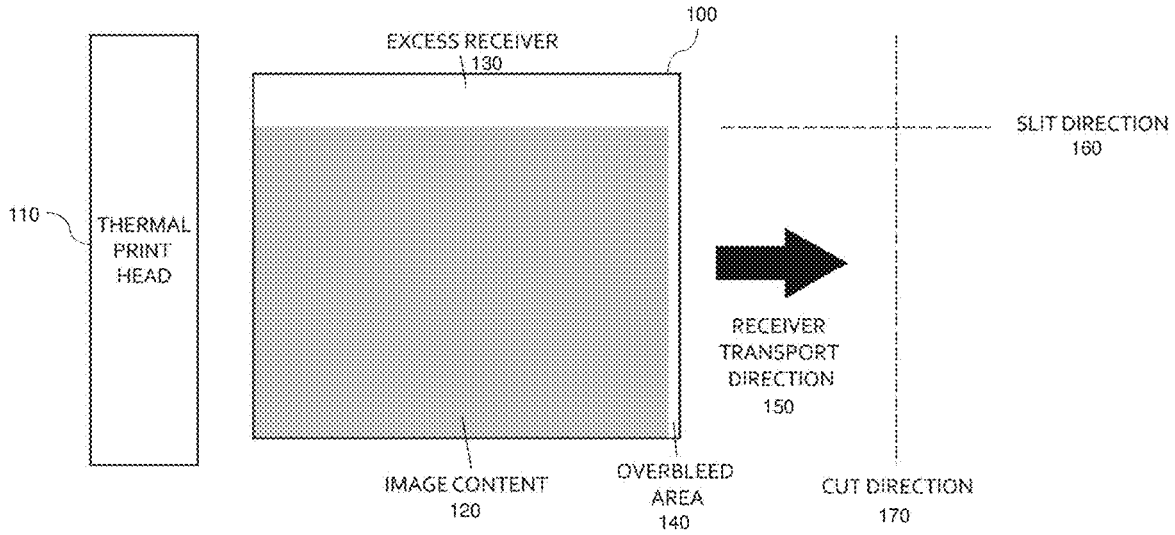
FIG. 1A illustrates an example image printed on a portion of a print medium.

FIG. 1A illustrates an example image 120 printed on a portion of print medium 100 by thermal print head 110 in the receiver transport direction 150. While a thermal print head is generally associated with a thermal printer, any suitable printer can be used in accordance with the embodiments described herein. Similarly, print medium 100 can consist of thermal paper or other media suitable for the printer used.

The image content 120 can be printed such that it uses the entire print medium 100, or only a subset of the print medium 100. If the entire print medium 100 is not used for printing, excess white space will be present on one or more sides of the print medium 100. The print medium 100 can include excess receiver 130 in the "width" direction on one or both sides, which can be cut with one or more slitters in slit direction 160. For example, if the print medium 100 is 6-inch wide and the image content 120 is 4-inch wide, a slitter can cut the excess 2 inches. The print medium 100 can also include overbleed area 140 in the "length" direction on one or both sides, which can be cut with one or more cutters in cut direction 170. For example, if the print medium 100 is 8-inch long and the image content 120 is 6.5-inch long, a cutter can cut the excess 1.5 inches. Slitters, cutters, and related components known in the prior art may be used, as described above. It should be understood that the order of components depicted in FIG. 1A and elsewhere is not the only contemplated arrangement. Other arrangements are possible and would be obvious to a person of skill based on this disclosure.

Figure 1B:
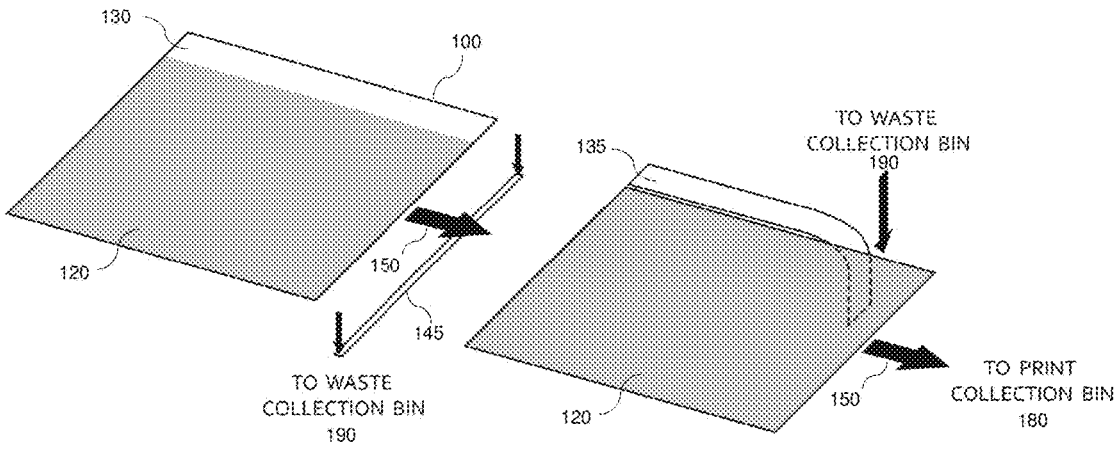
FIG. 1B illustrates an example of cutting the excess print medium.

FIG. 1B illustrates an example of cutting excess print medium from print medium 100. As print medium 100 travels in the receiver transport direction 150, excess receiver 130 can be cut with a slitter to form slitter waste 135. Likewise, overbleed area 140 can be cut with a cutter to form cutter waste 145. Slitter waste 135 and cutter waste 145 can be deposited in waste collection bin 190, or one or more waste collection bins. As described above, there can be excess receiver 130 and overbleed area 140 on both sides of the print medium 100. Therefore, slitter waste and cutter waste can be created from both sides. After the excess print medium is cut from the print medium 100, the image content 120 is ejected to the print collection bin 180.

Figure 2A:
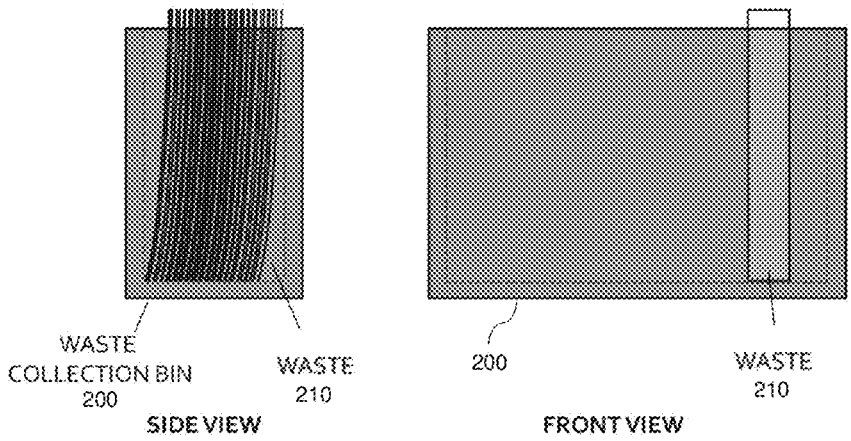
FIG. 2A illustrates an example of inefficient stacking of waste in a waste collection bin.

FIG. 2A illustrates an example of inefficient stacking of waste 210 in waste collection bin 200, without the benefits of the invention described herein. Waste 210 may consist of slitter waste, cutter waste, or other waste such as chads from hole punches. In this configuration, waste 210 is positioned vertically in waste collection bin 200, which results in an inefficient use of space. This can result issues such as paper jams or the bin overflowing.

Figure 2B:
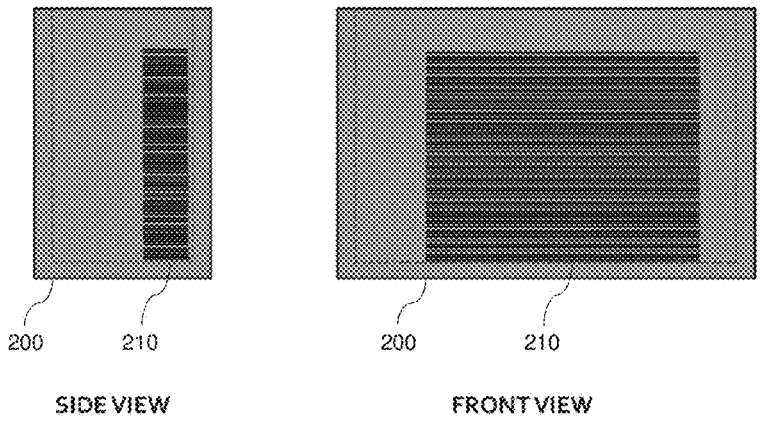
FIG. 2B illustrates an example of efficient stacking of waste in a waste collection bin.

FIG. 2B illustrates an example of efficient stacking of waste 210 in waste collection bin 200, using one or more embodiments of the invention described herein. Waste 210 may consist of slitter waste, cutter waste, or other waste such as chads from hole punches. In this configuration, waste 210 is positioned in a flat horizontal manner to most efficiently use the space in waste collection bin 200.

Figure 3:
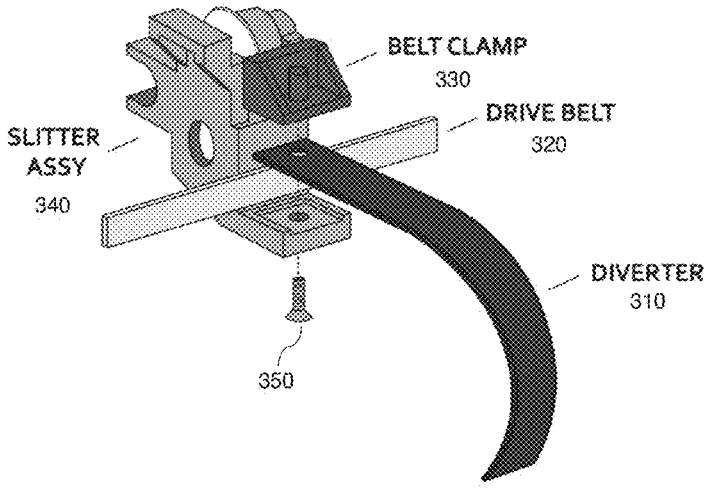
FIG. 3 illustrates an example waste diverter attached to a slitter assembly on a slitter drive belt.

FIG. 3 illustrates an example waste diverter 310 attached to slitter assembly 340 on a slitter drive belt 320. Waste diverter 310 is attached to slitter drive belt 320 using belt clamp 330 and screw 350. Note, however, that waste diverter 310 can be attached to other drive belts and may be attached in any manner. For example, waste diverter 310 can be attached to drive belt 320 using a rivet or other fastener. In the configuration in FIG. 3, waste diverter 310 mirrors the slitter location due to its attachment. In this manner, waste diverter 310 can easily direct slitter waste through the movement of slitter drive belt 320. An example of this waste direction is portrayed in FIG. 7A-7D, discussed below.

Figure 4:
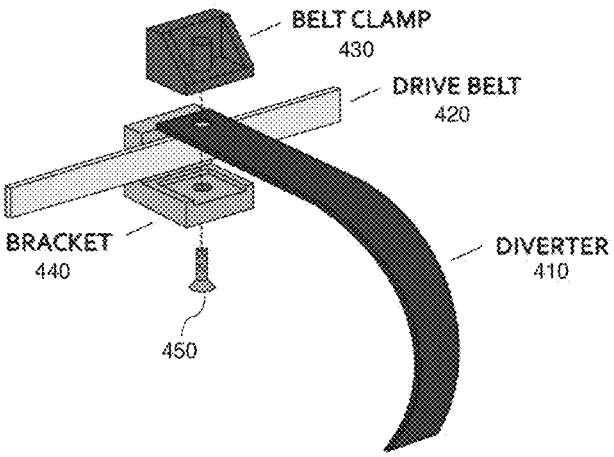
FIG. 4 illustrates an example waste diverter attached to a drive belt.

FIG. 4 illustrates an example waste diverter 410 attached to drive belt 420. The waste diverter 410 is attached to drive belt 420 using belt clamp 430, bracket 440, and screw 450. In this configuration, waste diverter 410 can be attached to a belt that is not connected to any other components, or other drive belts in the printer, such as the slitter or cutter drive belts. In this manner, waste diverter 410 can easily direct waste through the movement of drive belt 420. As above, waste diverter 410 can be attached to drive belt 420 in any manner.

Figure 5:
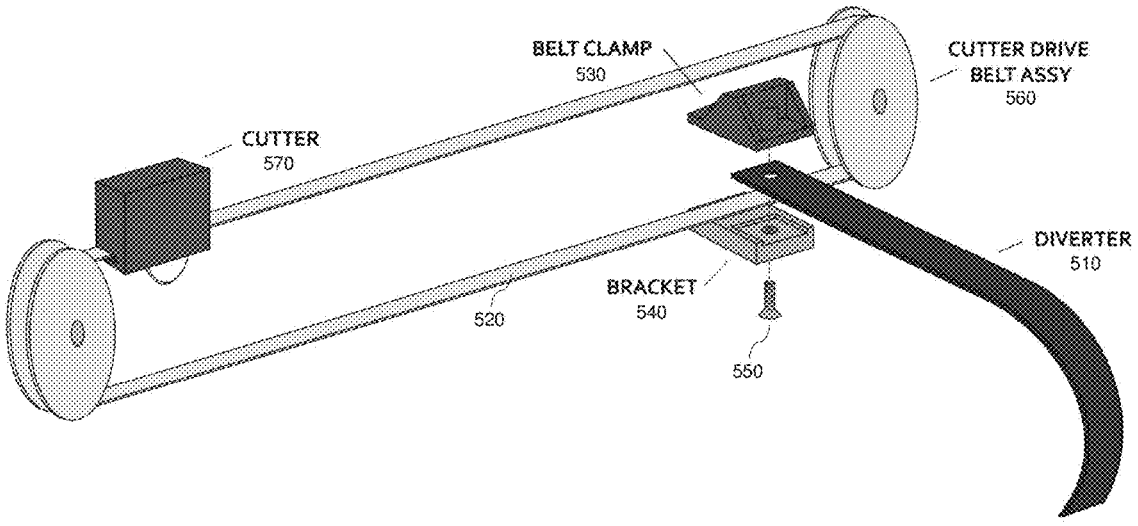
FIG. 5 illustrates an example waste diverter attached to a cutter drive belt.

FIG. 5 illustrates an example waste diverter 510 attached to cutter drive belt 520. The waste diverter 510 is attached to cutter drive belt 520 using belt clamp 530, bracket 540, and screw 550. Cutter 570 can also be attached to cutter drive belt 520. Cutter drive belt 520 can be moved using a cutter drive belt assembly 560. In the configuration in FIG. 5, waste diverter 510 has a fixed location on cutter drive belt 520 with respect to cutter 570. In this manner, waste diverter 510 can easily direct slitter or cutter waste through the movement of cutter drive belt 520. As above, waste diverter 510 can be attached to cutter drive belt 520 in any manner.

Figure 6:
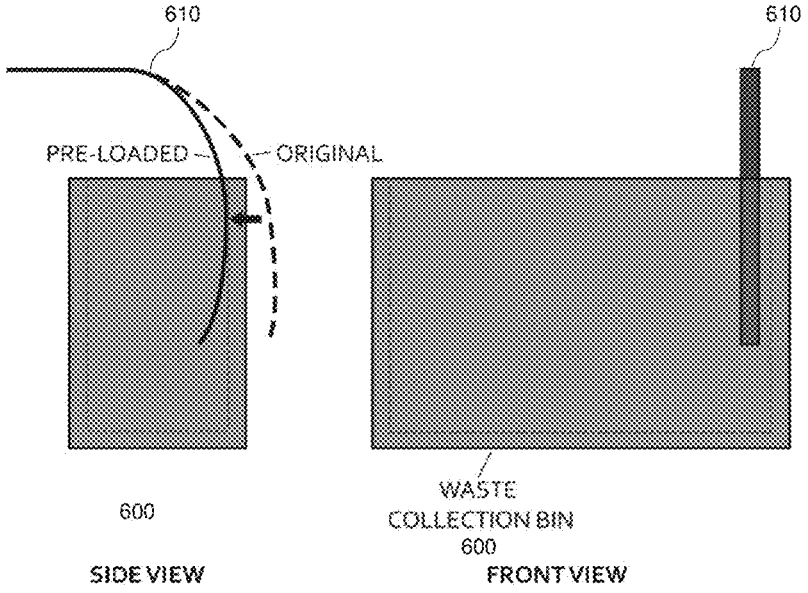
FIG. 6 illustrates an example waste diverter in a waste collection bin, with both side and front views.

FIG. 6 illustrates an example waste diverter 610 pre-loaded in waste collection bin 600. The dotted lines show the natural position of waste diverter 610 absent any force. As described above, waste diverter 610 can be made of a flexible material such as plastic. When waste diverter 610 is pre-loaded in waste collection bin 600, waste diverter 610 will bend and position itself such that it is touching the wall of waste collection bin 600. Therefore, when waste is deposited into waste collection bin 600 on the same wall, waste diverter 610 can direct the waste in a particular direction by moving in a particular direction. Such movement can be accomplished using drive belts such as those shown and described in relation to FIG. 3-5. An example of this is portrayed in FIG. 7A-7D, discussed below.

Figure 7A:
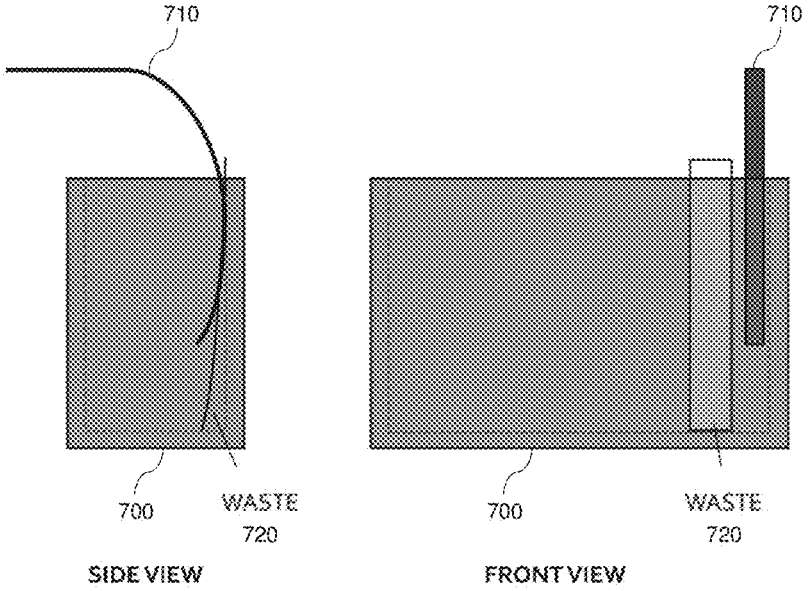
FIG. 7A-7D illustrate the use of an example waste diverter to direct waste, with both side and front views.
Figure 7B:
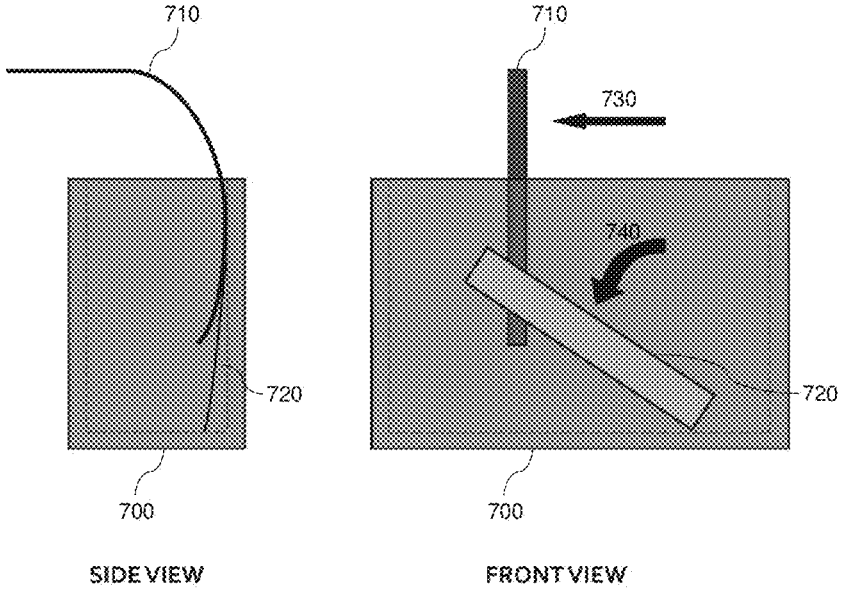
Figure 7C:
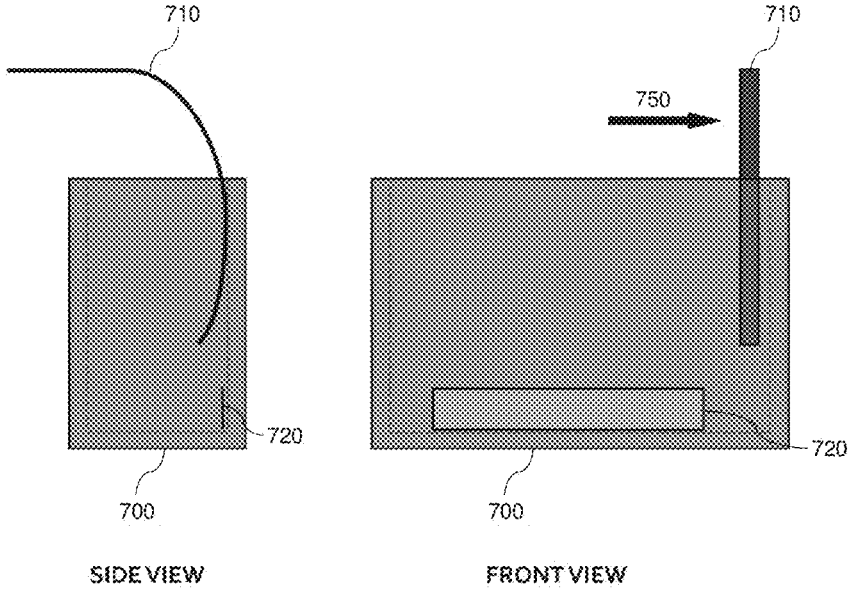
Figure 7D:
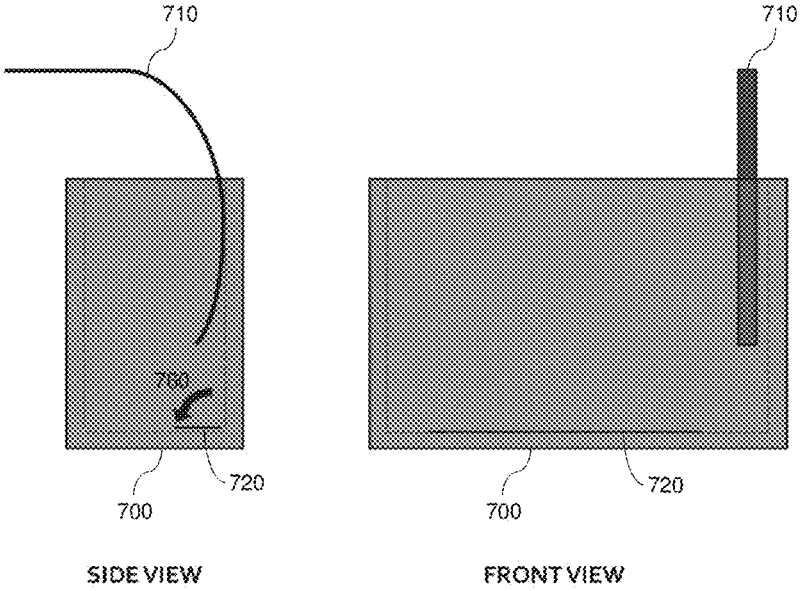

FIG. 7A-7D illustrates the use of an example waste diverter 710 to direct waste 720 to a desirable and efficient location in waste collection bin 700. As shown in FIG. 7A, after being cut from the print medium 100, waste 720 can drop vertically into waste collection bin 700. As discussed above, this is inefficient and undesirable. To alleviate this problem, waste diverter 710 can be positioned such that waste 720 will fall next to waste diverter 710, as shown in the front view of FIG. 7A. Waste diverter 710 can then move and direct waste 720 in a desired direction. In FIG. 7B, waste diverter 710 is shown moving in direction 730 to direct waste 720 to fall in direction 740. FIG. 7C shows waste 720 after it falls to a horizontal position at the bottom of waste collection bin 700. After moving in direction 730, waste diverter 710 moves in direction 750 back to its original position or another desired position. FIG. 7D shows waste 720 naturally falling via gravity in the direction 760 to a flat horizontal position at the bottom of waste collection bin 700.

Figure 7E:
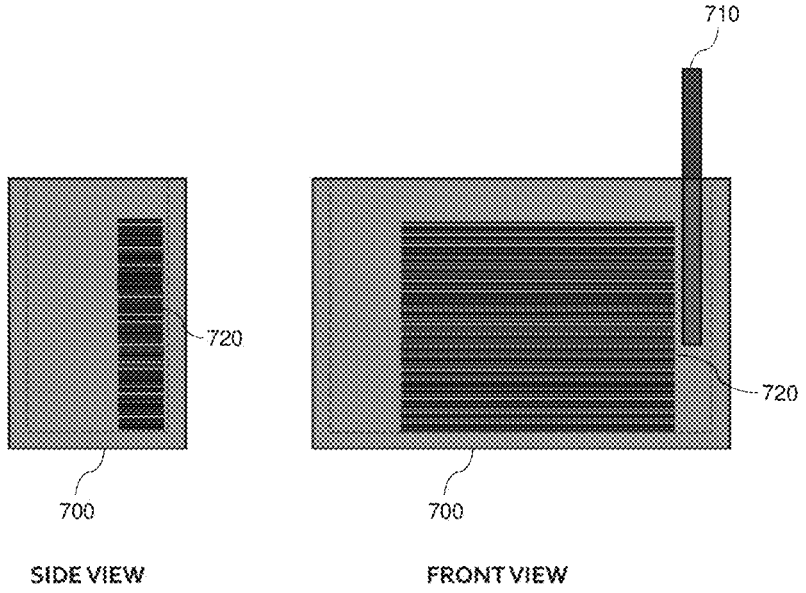
FIG. 7E illustrates an example of efficient stacking resulting from the process shown in FIG. 7A-7D, with both side and front views.

FIG. 7E illustrates the efficient stacking of waste 720 resulting from the process shown in FIG. 7A-7D in accordance with one or more embodiments of the invention. Waste 720 is stacked and positioned flat in a horizontal position at the bottom of waste collection bin 700, providing the most efficient use of space.

Figure 8:
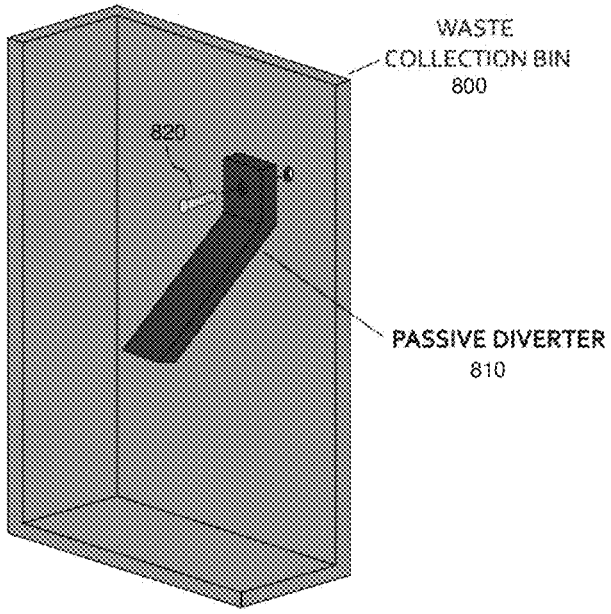
FIG. 8 illustrates an example passive waste diverter in a waste collection bin.

In another embodiment, FIG. 8 illustrates an example passive waste diverter 810 in waste collection bin 800. This is as opposed to the moveable waste diverters discussed above. The passive waste diverter 810 is shown attached to the waste collection bin 800 using a screw 820. Note, however, that passive waste diverter 810 can be attached to waste collection bin 800 in any manner.

Figure 9A:
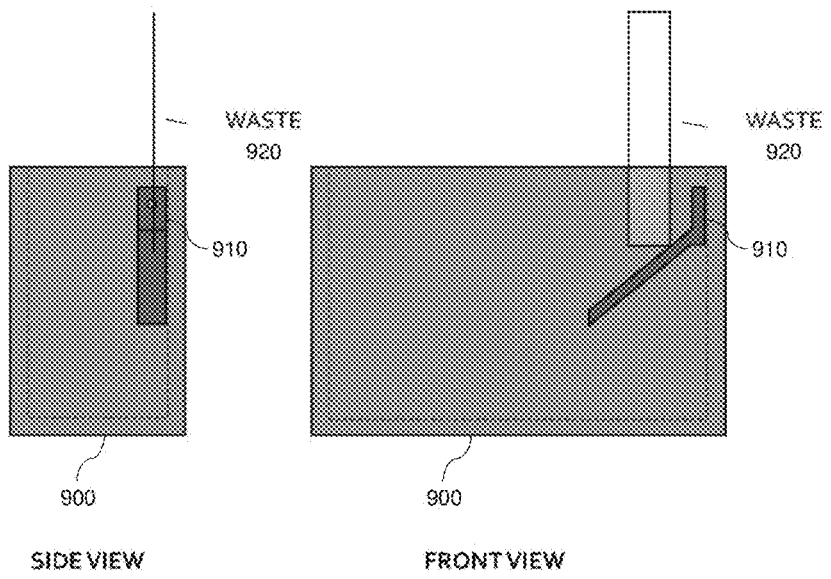
FIGS. 9A-9C illustrate the use of an example passive waste diverter to direct waste, with both side and front views.
Figure 9B:
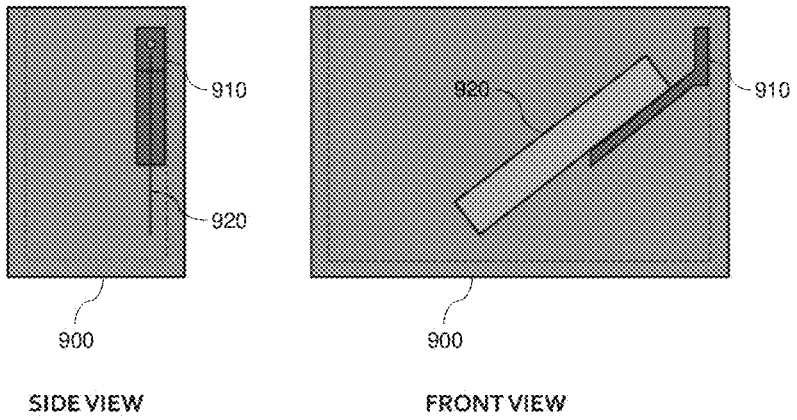
Figure 9C:
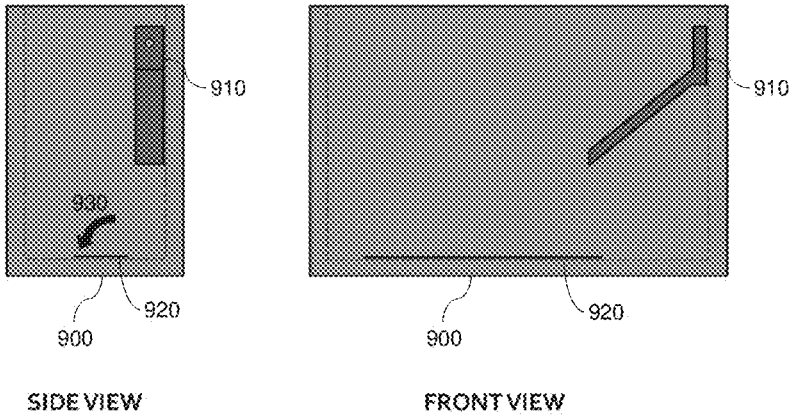

FIG. 9A-9C illustrate the use of an example passive waste diverter 910 to direct waste 920 to a desirable and efficient location in waste collection bin 900. As shown in FIG. 9A, after being cut from the print medium 100, waste 920 can drop vertically into waste collection bin 900. As discussed above, this is inefficient and undesirable. To alleviate this problem, passive waste diverter 910 can be positioned such that waste 920 will fall above it, as shown in the front view of FIG. 9A. Passive waste diverter 910 can then direct waste 920 in a desired direction. In FIG. 9B, passive waste diverter 910 is shown directing waste 920 to a horizontal position. FIG. 9C shows waste 920 after it naturally falls via gravity in the direction 930 to a flat horizontal position at the bottom of waste collection bin 900.

Figure 9D:
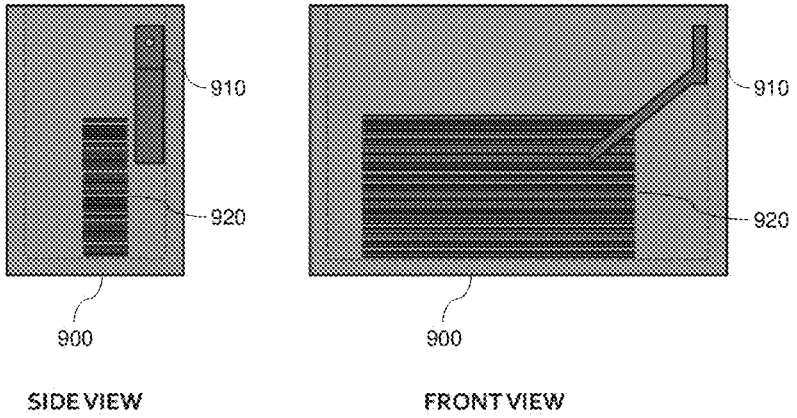
FIG. 9D illustrates an example of efficient stacking resulting from the process shown in FIG. 9A-9C, with both side and front views.

FIG. 9D illustrates the efficient stacking of waste 920 resulting from the process shown in FIG. 9A-9C in accordance with one or more embodiments of the invention. Waste 920 is stacked and positioned flat in a horizontal position at the bottom of waste collection bin 900, providing the most efficient use of space.

It will be apparent to persons of skill in the art that other configurations are possible through this disclosure. For example, one or more active or passive waste diverters can be used for slitter waste, cutter waste, other waste, or a combination thereof. The specification and drawings are, accordingly, to be regarded in an illustrative rather than a restrictive sense. It will be evident that various modifications and changes may be made thereunto without departing from the broader spirit and scope of the invention as set forth in the claims.

The invention claimed is:

1. A thermal printer, comprising:
at least one slitter mechanism;
at least one cutter mechanism;
at least one waste collection bin;
at least one waste diverter, wherein at least one waste diverter is constantly and substantially inside at least one waste collection bin; and
a slitter drive belt, wherein the slitter drive belt is attached to the at least one slitter mechanism and the at least one waste diverter.

2. The thermal printer of claim 1, further comprising:
a drive belt, wherein the drive belt is attached to the at least one waste diverter.

3. The thermal printer of claim 1, wherein the at least one waste diverter is made of a flexible material.

4. A thermal printer, comprising:
at least one slitter mechanism;
at least one cutter mechanism;
at least one waste collection bin;
at least one waste diverter, wherein at least one waste diverter is constantly and substantially inside at least one waste collection bin;
a cutter drive belt, wherein the cutter drive belt is attached to the at least one cutter mechanism and the at least one waste diverter.

5. The thermal printer of claim 4, further comprising:
a drive belt, wherein the drive belt is attached to the at least one waste diverter.

6. The thermal printer of claim 4, wherein the at least one waste diverter is made of a flexible material.

* * * * *